United States Patent [19]

van Bogaert et al.

[11] Patent Number: 4,781,222

[45] Date of Patent: Nov. 1, 1988

[54] FABRIC WINDING DEVICE FOR WEAVING LOOMS

[75] Inventors: Philippe van Bogaert, Schaerbeek; Willy Dejonckheere, Ypres, both of Belgium

[73] Assignee: Picanol N.V., Belgium

[21] Appl. No.: 17,478

[22] Filed: Feb. 24, 1987

[30] Foreign Application Priority Data

Feb. 24, 1986 [BE] Belgium ..... 904266

[51] Int. Cl.[4] ..... D03D 49/20

[52] U.S. Cl. ..... 139/307

[58] Field of Search ..... 139/304, 307, 308; 66/149; 242/75.2, 65

[56] References Cited

U.S. PATENT DOCUMENTS

| | | | |
|---|---|---|---|
| 788,798 | 5/1905 | Steele | 139/307 |
| 3,066,704 | 12/1962 | Moberg | 139/304 |
| 3,698,446 | 10/1972 | Miller et al. | 139/308 |
| 3,910,319 | 10/1975 | Bassing et al. | 139/308 |
| 4,028,912 | 6/1977 | Schneck | 139/308 |
| 4,192,353 | 3/1980 | Hintsch | 139/307 |
| 4,276,911 | 7/1981 | Pfarrwaller | 139/308 |

FOREIGN PATENT DOCUMENTS

| | | | |
|---|---|---|---|
| 630120 | 5/1936 | Fed. Rep. of Germany . | |
| 1785317 | 2/1972 | Fed. Rep. of Germany . | |
| 890076 | 10/1943 | France | 139/308 |

*Primary Examiner*—Henry S. Jaudon
*Attorney, Agent, or Firm*—Bacon & Thomas

[57] ABSTRACT

A fabric take-up system for a weaving loom includes a driven take-up roll and a pressure roll forming a nip with the take-up roll, wherein the take-up roll at least is movable transversely of its axis so that tensioned fabric received from the loom breast beam, wrapped around the take-up roll, through the nip and around the pressure roll urges the take-up roll towards the pressure roll. Devices for releasing the rolls to open the nip are described, including a support system for preventing deflection of the pressure roll over its length.

10 Claims, 3 Drawing Sheets

FABRIC WINDING DEVICE FOR WEAVING LOOMS

BACKGROUND OF THE INVENTION

This invention concerns a fabric take-up system for weaving looms.

Fabric take-up devices are already known for instance as described in U.S. Pat. No. 4,276,911 wherein there is described a take-up "roll" and several stretching rolls. Devices of this kind have the disadvantage that the initial tension force on the fabric which pulls the fabric through the various stretching rolls is reduced all around the periphery of these rolls to a fraction of its original magnitude. Consequently, the tension force on the fabric only supplies a limited contribution to the stretching effect on the fabric which is necessary between the different rolls. Also, these devices do not separately provide a stretching force on the fabric at the level of the fabric roll. Moreover, this device has the disadvantage that slipping will occur when the fabric roll is moved away. These devices have also the disadvantage that the resistance to deflection or the stiffness of the stretching rolls and of the take-up roll are relatively limited in larger (wider) weaving looms.

SUMMARY OF THE INVENTION

The present invention is thus aimed to propose a fabric take-up system for weaving looms which is not affected by the disadvantages reported hereabove. This fabric take-up device more specifically has the advantage that during weaving, as well as when a fabric roll is being exchanged, no slipping of the fabric will occur in the take-up device. Additionally, the tension force on the fabric is used in order to press the fabric or the canvas against the take-up roll.

Other advantages of the fabric winding device according to the invention include the fact that the fabric tension can be relatively easily released out between the rolls when switching to the weaving of another article. An additional advantage consists of the possibility that the device according to the invention can employ a take-up roll of relatively light weight, but which does not exhibit any noticeable deflection.

To this end the fabric winding device according to the invention is mainly composed of the combination of a breast beam or similar beam, of a take-up roll, of a pressure roll and of at least one support roll which can cooperate with the pressure roll. The take-up roll is supported in a manner which permits transverse movement in at least one direction in order that it may be moved in a direction toward the pressure roll and, the mutual location of the aforesaid elements is such that the fabric is mainly guided directly onto the take-up roll and around at least 225° of the periphery of the take-up roll. The fabric is then passed between the take-up roll and the pressure roll and then is wrapped over the pressure roll so that the fabric is passed between the pressure roll and the support roll and is finally withdrawn to the fabric roll.

BRIEF DESCRIPTION OF THE DRAWINGS

For a better understanding of the invention, reference is made to the drawings, in which.

DETAILED DESCRIPTION OF PREFERRED EMBODIMENTS

Figure 2:
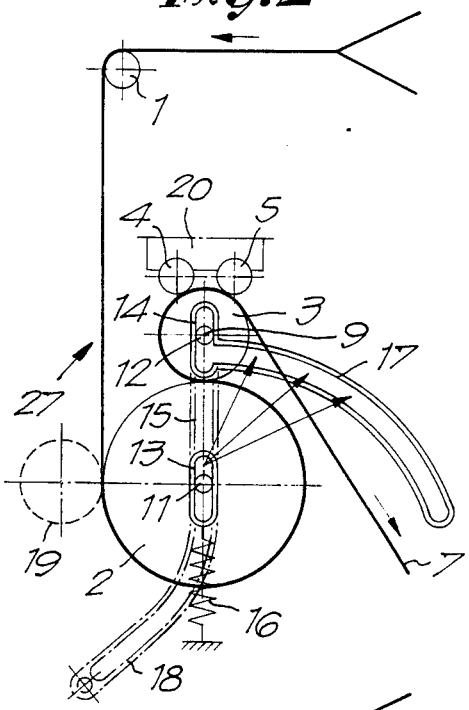
FIG. 2 illustrates a preferred embodiment of the invention.

As illustrated in the figures, the fabric take-up device for a loom according to the invention is mainly composed of the combination of a rotary or stationary breast beam (other known loom details are omitted) 1 or similar beam, of a take-up roll 2, of a pressure roll 3 and of several support rolls 4 and 5 for reacting loads from the pressure roll 3 into the loom frame 4 (see FIG. 2). Moreover, a fabric roll 6 is also employed in order to wind up the woven product or the fabric 7. According to the invention, the location of all aforesaid elements is such that the woven product 7, after leaving the breast beam, is guided directly to the take-up roll and around at least 225° of the periphery of the take-up roll 2, is then passed around its far side and then through the nip end N formed between the take-up roll 2 and the pressure roll 3 and is then wrapped over the pressure roll 3 so that it passes between the pressure roll 3 and the support roll or rolls 4 and 5 and is finally withdrawn back generally towards the take-up roll 2 to the fabric roll 6.

Figure 1:
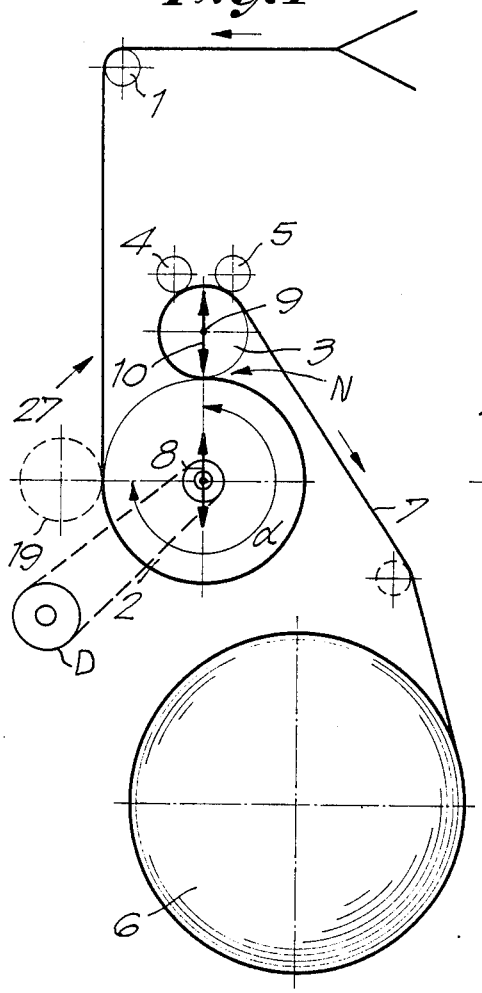
FIG. 1 schematically illustrates the fabric take-up system according to the invention.
Figure 3:
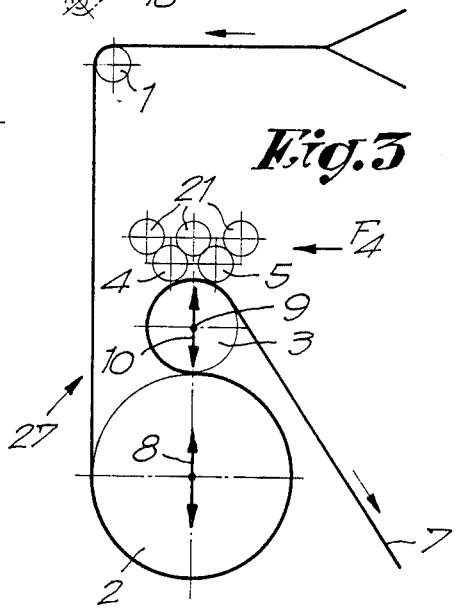
FIG. 3 schematically illustrates an alternative embodiment of the fabric take-up device.

According to the present invention, the take-up roll 2 is movably supported peripherially for movement in a radial or transverse direction whereby the movement direction 8 is such that the take-up roll 2 can cooperate with the pressure roll 3. To this end, the rotation axis of the pressure roll 3 preferably lies in the line of (or the same plane as) this movement direction 8, as illustrated by FIGS. 1, 2, and 3, although such is not necessary.

According to two alternative embodiments of the present invention, the pressure roll 3 can be supported either to permit its radial movement or to prevent such motion. In the case where the pressure rolle 3 is movably supported for radial movement, the movement directions 8 and 10 or the take-up roll 2 and of the pressure roll 3 respectively should preferably lie along the same line during normal functioning of the loom.

The aforesaid support rolls 4 and 5 can cooperate along the periphery of the pressure roll 3 in this embodiment. That is, they provide support between the pressure roll 3 and loom frame 20 to prevent displacement of pressure roll 3 towards the frame, particularly by deflection due to fabric tension.

Preferably the take-up roll 2, the pressure roll 3 and the support rolls are arranged as illustrated by FIGS. 1 - 7 whereby the fabric 7 is guided vertically downwards after the breast beam 1 and then over an angle of 270° over the periphery of the take-up roll 2, through nip N, and finally wrapped over the pressure roll 3. The pressure roll 3 is located exactly above the take-up roll 2 between breast beam 1 and take-up roll 2, while the support rolls 4 and 5 are located above the pressure roll between the roll 3 and loom frame 5.

The functioning of the fabric winding device includes mainly the following operations: The take-up roll 2 is pulled by the tensile force of the woven product against the pressure roll 3 towards breast beam 1 whereby the fabric 7 is clamped in the nip N between both rolls. In the embodiment where the pressure roll 3 is also movable supported, this pressure force is used a second time between the support rolls 4 and 5 and the pressure roll 3 due to fabric tension tending to move take-up roll upwardly toward the breast beam. As the fabric 7 is directly guided on the take-up roll 2, the tensile force on the woven product is thereby completely utilized in order to maximize the compression between the take-up roll 2 and the pressure roll 3.

FIG. 2 illustrates a practical embodiment whereby the take-up roll 2 and the pressure roll 3, as described above, can be moved because they are supported with their shafts, 11 and 12, respectively, preferably in groove elongated guiding elements, respectively 13 and 14. The guiding elements 13,14 may also be composed of a continuous groove 15, as illustrated in dotted lines, and this groove can be made in the loom side frames or similar element supporting the rollers. According to a special alternative embodiment, the take-up roll 2 is also urged or biared upwardly by means of springs 16 toward the pressure roll 3 in order, on the one hand, to obtain an additional compression force against the pressure roll at the nip and, on the other hand, to permit the device to exert a compressive force when no initial tension exists in the fabric. Quite obviously these elongated guiding elements can also be replaced by any other mechanical equivalent element.

The aforesaid guiding element 14 for the pressure roll 3 is preferably equipped with an additional guide 17 connected to it and which gradually curves away from the take-up roll 2. Such a guide 17 enables the take-up roll 2 to be be pushed first downwards against the spring pressure of the springs 16 to thereby enable the pressure roll 3 to be moved in the guide 17 in such a way that the pressure roll 3 is moved away from the tension roll 2 to permit switching over to another article of fabric which can now be easily introduced between the two rolls.

According to an alternative embodiment, the groove-shaped guiding element 13 of the take-up roll 2 may also be located in a pivoting frame 18 which is schematically illustrated in dotted lines in FIG. 2. A motion stop 19 in the form of a roller on a fixed axis prevents leftward motion of the take-up roll 2 (the fabric tension urges the take-up roll to the left at all times).

In all embodiments, the take-up roll 2 is equipped with a driving means D (FIG. 1) in order to achieve the take-up winding movement of the fabric 7. The drive is preferably transmitted by means of a chain. Such a drive can be made according to several well known methods and therefore its description is unnecessary.

As illustrated in FIG. 2, the support rolls 4 and 5 preferably provide continuous support for pressure roller 3 across the loom frame 20. This design makes deflection from bending of the support rolls 4 and 5 pressure roll 3 and take up roll 2 due to fabric tension, nearly negligible.

Figure 5:
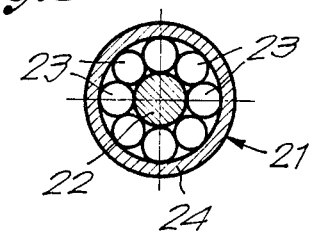
FIG. 5 is a cross-section along line V—V of FIG. 4.
Figure 4:
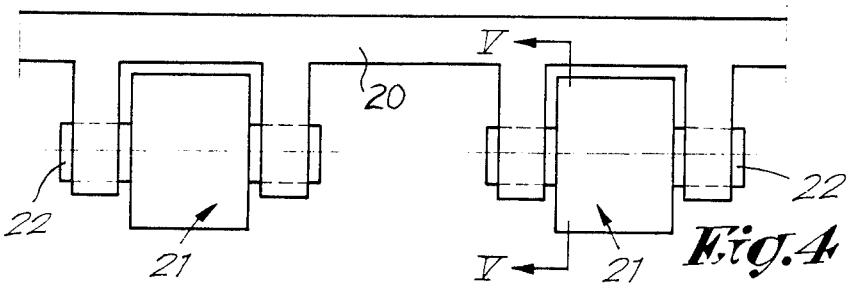
FIG. 4 is a detailed view of the fabric take-up device in the direction of arrow F4 of FIG. 3.

As illustrated on FIG. 3, the support rolls 4 and 5 are preferably supported by rotating elements 21 between support rolls 3 and frame 20, and which are preferably composed of rollers in such a way that the friction between the support rolls and the loom frame 20 is reduced. These rollers may be provided continuously over the full width of the weaving loom or be composed of several parts as illustrated by FIG. 4. Quite obviously, these rollers may also be mounted at some distance from each other. This depends upon the stiffness of the pressure roll 3. As illustrated by FIG. 5 each roller is mainly composed of a centrally supported shaft 22 and of a hollow shaft 24 supported around it by means of rotating bearing elements 23.

Figure 6:
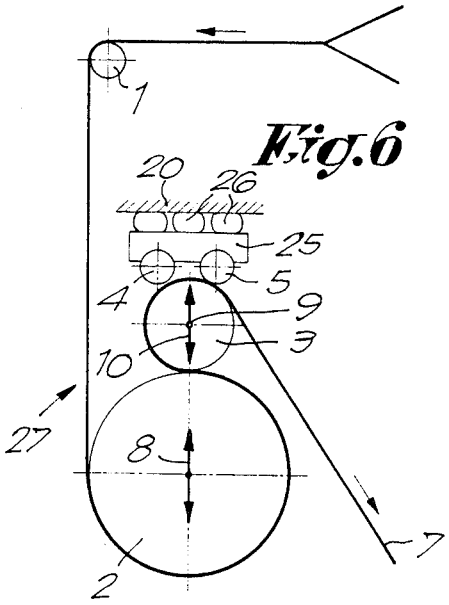
FIG. 6 is still another alternative embodiment of the invention.

The fabric take-up device as described hereabove is also suitable to prevent or avoid "starting lines" in the fabric 7 by adjusting fabric tension at start up of the loom. To this end and as illustrated in FIG. 6, the support rolls 4 and 5 are supported in a support part 25 which is in turn supported by means of extensible pressure conduits 26 extending across the loom frame 20. By regulating the pressure in the conduits 26, by suitable controls the support part 25 may be extended toward or retracted away from the pressure roll 3, thereby adjusting the clamping force between rolls 4, 5 and 3 and the tensile force on the fabric. This effectively moves the fell of the cloth away from the beat-up slightly at start-up until full fabric (warp) tension and motion is established. Moreover, the pressure regulation in these pressure conduits 26 can be controlled by any well known method in such a way that a displacement of the support path 25 towards or away from the pressure rolls can be achieved whereby the adjustment of the tension in the fabric 7 between the rolls 4, 5 and 3 can occur.

Figure 7:
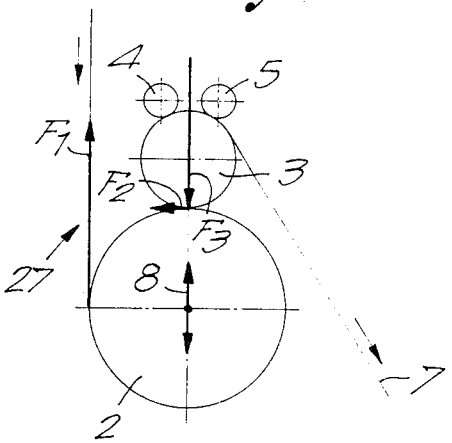
FIG. 7 illustrates the balance of forces established when the fabric take-up device is functioning.

In order to illustrate the functioning of the invention, FIG. 7 indicates some of the force distribution in a fabric take-up device. The forces are mainly composed, in this case, of the initial tensile force in the woven product F1 in the part 27 of the fabric 7 entering the rolls, from the breast beam of the remaining force F2 in the woven product, which is in horizontal direction in the present case, and of the pressure force F3 which exists at the nip N between the take-up roll 2 and the pressure roll 3. The vertical force balance clearly indicates that, with a fabric winding device according to the invention, and more specifically if the parts are located as illustrated in FIG. 7, the pressure force F3 is equal to the initial force F1 on the woven product or in other words, that the initial force F1 in the woven product is completely used in order to create a pressure force F3 between the take-up roll 2 and the pressure roll 3. In this way the remaining force F2 in the woven product after the contact point between both rolls 2 and 3 is reduced to an extremely small value.

Figure 8:
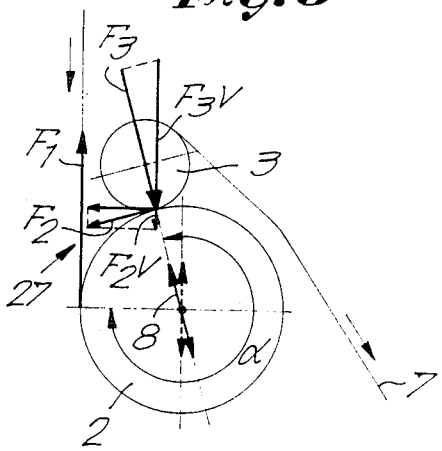
FIGS. 8 and 9 illustrate additional alternative embodiments.
Figure 9:
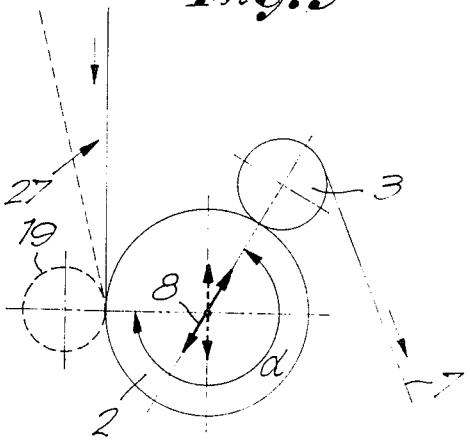

Quite obviously, the invention is by no means limited to the embodiment according to FIG. 7, as the support roll 2 may also be rotated as illustrated on FIGS. 8 and 9. The pressure force F3 is, however, smaller in this case than the initial force F1 in the woven product, as, on the one hand, the remaining force F2 in the woven product has a vertical component F2-V and, on the other hand, the pressure force F3 is no longer oriented parallel to the part 27 of the fabric 7 entering the rolls. Consequently, it is obvious that, according to the invention, the embracing angle of the fabric 7 aroung the periphery of the take-up roll 2 is comprised preferably between 225° and 315° in order to avoid the pressure force F3 becoming too small and thereby jeopardizing the effect of the invention.

As schematically illustrated by arrows in FIGS. 8 and 9, the movement direction 8 along which the take-up roll 2 can be freely moved can be directed either toward the pressure roll 3 or to any other direction which is very closely oriented toward the pressure roll, as for instance parallel to the entering part 27 of the fabric 7.

As already described, it is necessary, according to the invention, that the fabric 7 be mainly guided directly onto the take-up roll 2. This way the initial force F1 in the woven product is, indeed, kept at its maximum value and no force loss occurs because the fabric 7 is guided over support rolls or tension rolls. Nevertheless, the entering part 27 of the fabric 7 may be guided according to the invention over a small angle over the support roll 19 or any similar element without, however, departing from the scope of this invention. This is schematically illustrated in FIG. 9.

Figure 10:
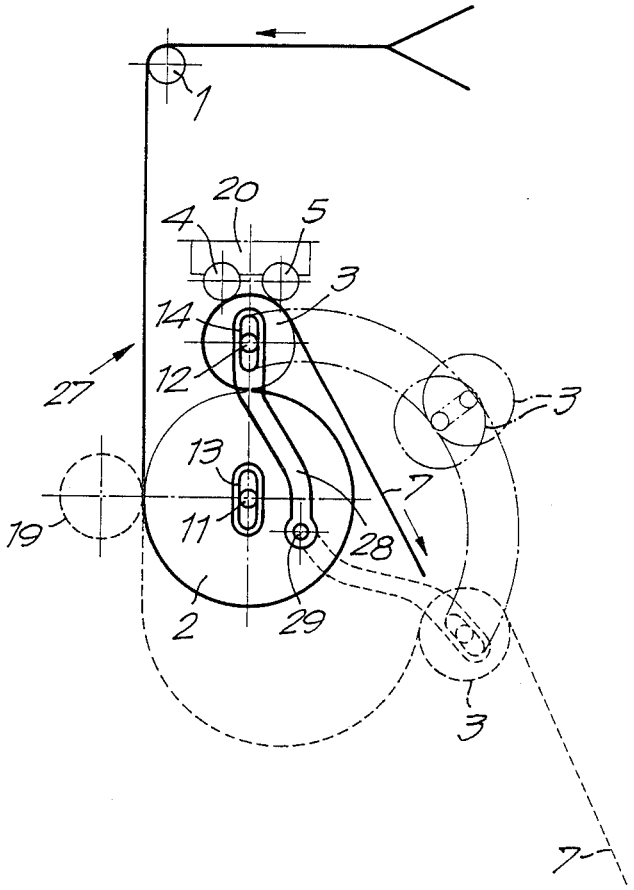
FIG. 10 is still another embodiment of the device depicted in FIG. 2.

Quite obviously, the fabric take-up device lends itself to a large number of embodiments. For instance, as still illustrated in FIG. 10, the aforesaid additional guide 17 may be replaced by a rotatable arm 28 which is equipped at its moveable end with the aforesaid guiding element 14 for the shaft 12 of the pressure roll 3, with the rotation center 29 located eccentrically towards the shaft 11 of the take-up roll 2. The pressure roll 3 and the take-up roll 2 can be pushed apart from each other by a rotation movement of the arm 24.

The present invention is by no means limited to the embodiments described as examples and by the figures in appendix but such a fabric winding device as well as its components can be made in any shape and size without departing from the scope of the invention.

What is claimed is:

1. A fabric take-up system for a weaving loom including a breast beam for woven fabric comprising:

a driven rotatable take-up roll extending parallel to the breast beam arranged to receive woven fabric from the breast beam, the take-up roll being mounted on the loom so that the take-up roll has freedom to move transversely of its rotary axis at least in the general direction of the breast beam and so that a fabric under tension extending from the breast beam wrapped over the take-up roll from an entry area on the periphery of the take-up roll moving away from the breast beam during driven movement of the take-up roll, beneath the rotary axis of the take-up roll, and then around the take-up roll back towards the breast beam tends to move the take-up roll in reaction to the tension force of the fabric transversely of the axis of the take-up roll at least generally in the direction of the breast beam;

a pressure roll disposed parallel and contiguous to the take-up roll to form a nip between the take-up and pressure rolls, said pressure roll disposed generally between the take-up roll and the breast beam, said nip disposed so that the path of a fabric take-up extends from the breast beam and around the side of the take-up roll disposed away from the breast beam and back towards said breast beam before encountering said nip;

support means for the pressure roll arranged to prevent displacement of the pressure roll away from the nip;

whereby tensioned fabric extending from the breast beam around the take-up roll, through said nip and around a portion of the pressure roll will produce a nip pressure between the take-up roll and the pressure roll by tending to move the take-up roll transversely of its axis towards the pressure roll.

2. A fabric take-up system as claimed in claim 1, wherein the path of movement of a fabric over the take-up roll includes a wrap angle over said take-up roll of approximately 270°.

3. A fabric take-up system as claimed in claim 1, said pressure roll being mounted on the loom with freedom of movement transversely of its axis of least toward said take-up roll, and wherein the path of movement of a fabric over the pressure roll extends from the nip, around the side of the pressure roll disposed away from the take-up roll and generally back towards the take-up roll, whereby fabric tension tends to drive the pressure and take-up rolls towards each other.

4. A fabric take-up system as claimed in claim 1, said take-up roll and pressure roll both being mounted for transverse movement towards and away from each other in a common plane.

5. A fabric take-up system as claimed in claim 1, including biasing means arranged to bias said take-up roll towards said pressure roll.

6. A fabric take-up system as claimed in claim 1, said take-up roll mounted on a pivotal guide means arranged to release the take-up roll away from the nip when the guide means is pivoted.

7. A fabric take-up system as claimed in claim 1, said pressure roll being mounted to the loom by a pivotable guide means, said pressure roll being moved away from the take-up roll in a direction to open the nip and release tension on a fabric wrapped around the take-up and pressure rolls when said guide means is pivoted.

8. A fabric take-up system as claimed in claim 1, said pressure roll mounted in guide means arranged to permit transverse movement of the guide roll away from the take-up roll in a direction to open the the nip and release tension in a fabric wrapped over the take-up and pressure rolls.

9. A fabric take-up system as claimed in claim 1, said support means comprising support rollers engaging the pressure roller at areas along its length and being mounted to the loom on fixed axes of rotation, whereby the pressure roll is supported along its length against motion away from the nip.

10. A fabric take-up system as claimed in claim 9, including means for selectively adjusting the position of the support rollers relative to the nip so that the nip pressure can be selectively adjusted.

* * * * *